US006920923B1

(12) United States Patent
Pietrobelli et al.

(10) Patent No.: US 6,920,923 B1
(45) Date of Patent: Jul. 26, 2005

(54) SECTION MILL FOR WELLS

(76) Inventors: Alejandro Pietrobelli, Ctro Cial.Tacariua, Ave Intercommunal, Tia Juana, Edo Zulia (VE); Fausto Pietrobelli, Ctro Cial.Tacariua, Ave Intercommunal, Tia Juana, Edo Zulia (VE)

( * ) Notice: Subject to any disclaimer, the term of this patent is extended or adjusted under 35 U.S.C. 154(b) by 105 days.

(21) Appl. No.: 10/666,015

(22) Filed: Sep. 22, 2003

(51) Int. Cl.[7] ..... E21B 10/66; E21B 29/00

(52) U.S. Cl. ..... 166/55.8; 166/55.2; 166/55.7; 175/269; 175/286; 175/289

(58) Field of Search ..... 166/55, 55.1, 55.2, 166/55.7, 55.8, 55.6; 175/265, 266, 269, 175/273, 284, 286, 289

(56) References Cited

U.S. PATENT DOCUMENTS 2,735,485 A * 2/1956 Metcalf ..... 166/55.8
2,899,000 A * 8/1959 Medders et al. ..... 166/55.8
5,074,355 A 12/1991 Lennon

* cited by examiner

*Primary Examiner*—David Bagnell
*Assistant Examiner*—G M Collins
(74) *Attorney, Agent, or Firm*—J Sanchelima; A. Bordas

(57) ABSTRACT

A section mill for casings used in oil wells to cut predetermined portions for repair purposes. An elongated cylindrical assembly is inserted through the casing and it includes at least two spaced apart apertures with one blade member pivotally mounted within each aperture. First and second coaxially disposed tubular shaft assemblies with teethed portions to coact with the blades to selectively move them between two extreme position upon the application of a pressurized fluid. The fluid needs to overcome the spring biased applied to the shaft assemblies. The first set of blades is stopped and slidably rotates in contact with the internal surface of the casing. The second set cuts through the casing with one end and sections the casing with the other end. After wearing off, the first set of blades continues the sectioning work.

4 Claims, 8 Drawing Sheets

10
22
28
20
38
43
33
36
30
70
46
15
80
48
25
50
53
52
26
34
40
32
27
60
62
24
44
42
23

10
22
28
20
38
43
33
36
30
70
46
15
80
48
50
25
53
52
26
34
40
32
27
62
60
24
44
42
23

10
22
28
20
38
43
33
36
30
70
46
15
80
48
50
25
53
52
26
34
40
32
27
62
60
24
44
42
23

10
22
28
20
38
43
33
36
30
70
46
15
80
48
50
25
53
52
26
34
40
32
27
62
60
24
44
42
23

28
22
10
20
38
43
33
30
36
70
15
46
80
48
50
53
52
25
26
34
40
32
27
60
62
24
44
42
23

28
22
10
20
38
43
33
36
30
70
46
80
48
50
53
52
25
26
34
15
40
32
27
60
62
24
44
42
23

SECTION MILL FOR WELLS

BACKGROUND OF THE INVENTION

1. Field of the Invention

The present invention relates to a section mill for wells, and more particularly, to a section mill that permits a user to extend the cutting performance of the apparatus without retrieving it from the well.

2. Description of the Related Art

In the operation of oil wells, it is common during the maintenance stage to abandon the deepest portion of the casing (when it is in poor conditions) and open a casing window to install a new casing portion, typically, at an angle with respect to the previous casing, to reach oil deposits through a new path. Section mills are utilized to mill portions of a casing to accomplish this. In doing so, the casing needs to be cut from inside the casing and, subsequently, longitudinally reduced. The blades wear off and the conventional mills need to be retrieved to replace the blades and reinsert the mill.

Many designs for section mills have been designed in the past. The present invention includes a second set of blades that is deployed after the first set has been consumed milling the casing portion being replaced. This obviates the time consuming task of taking out the section mill assembly to change the used up set of blades and replace it with a new one.

Applicant believes that the closest reference corresponds to U.S. Pat. No. 5,074,355 issued to Lennon on Dec. 24, 1991 for a section mill with multiple cutting blades. Lennon's patented section mill for cutting through well casing includes multiple sets of cutting blades which are selectively engaged to continue cutting operations as blades dull. The cutting blade sets are selectively indexable such that as a first set dulls or fails a succeeding set can be utilized following retraction of the first set. The section mill also includes a central mandrel having offset cammed surfaces, which engage the cutting blades and cause them to expand outwardly. The mandrel is axially displaceable by a piston affected by hydraulic pressure. As the mandrel is axially displaced the indexed cutting blades are expanded by the cammed surface. Indexing is accomplished by a cam drum, which allows the mandrel to be rotated relative to the cutting blades in order to align the next cammed surfaces with their respective cutting blades.

However, it differs from the present invention because a mandrel for indexing the blades is not required. In the present invention the second set of blades is automatically deployed once the cut section of the casing is reached. Subsequently, the second (or other blades) will not be used until the first blade is completely worn off. This simpler approach eliminates several critical elements required in Lennon's section mill.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a tool for extending its performance of cutting a casing at predetermined depths in a well without requiring the withdrawal of the section mill tool.

It is another object of this invention to provide a section mill tool for wells that includes at least two sets of blade assemblies wherein at least one of the sets is distended after an initial section of the casing has been cut.

It is still another object of the present invention to provide a tool that is easy to install and operate.

It is yet another object of this invention to provide such a tool that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
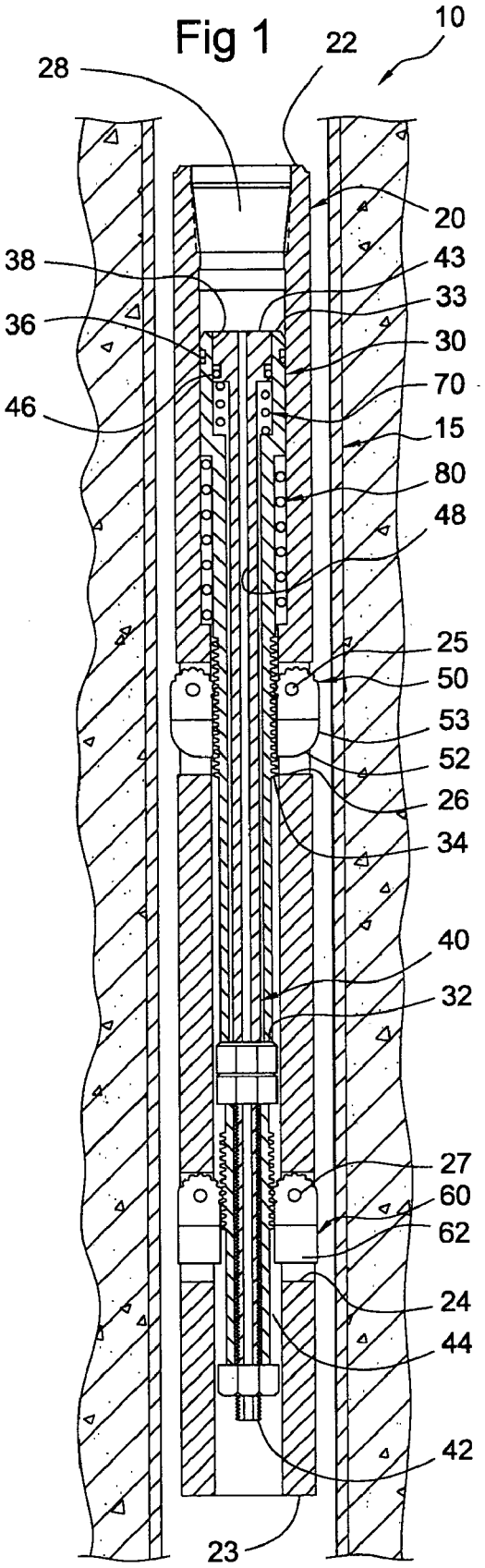
FIG. 1 shows a partial cross sectional view of the section mill tool assembly, inside an oil well bore.
Figure 2:
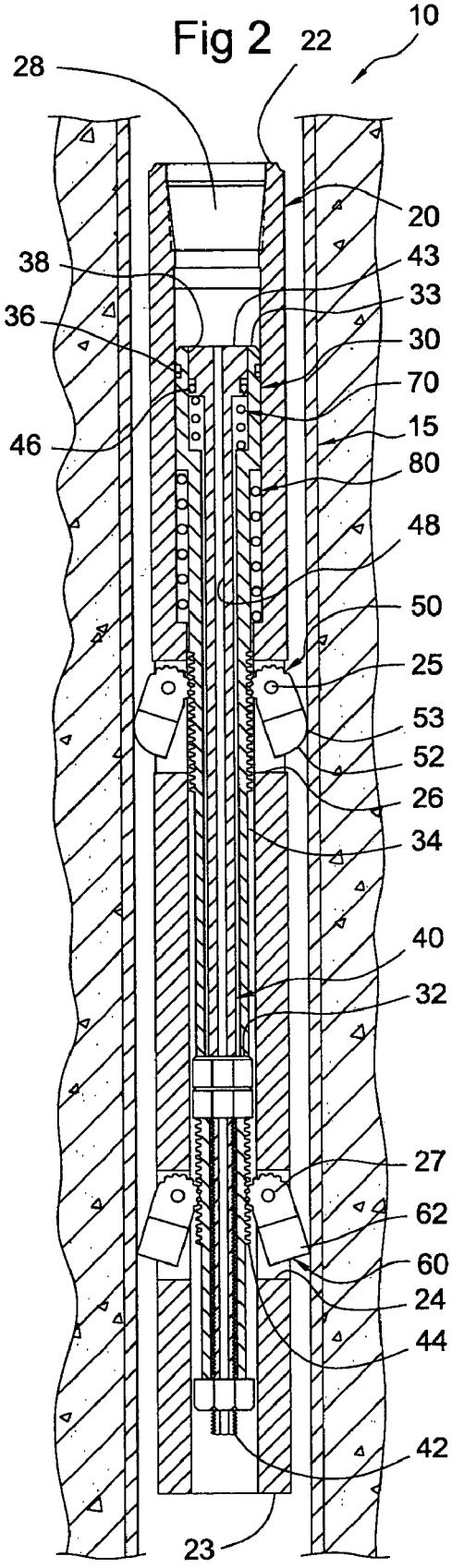
FIG. 2 is a cross sectional view of the section mill tool assembly, with the blades being distended against the casing by fluid pressure. The first set of blades start cutting the internal wall of the casing while the second set of blades comes in slidable contact with the casing.
Figure 3:
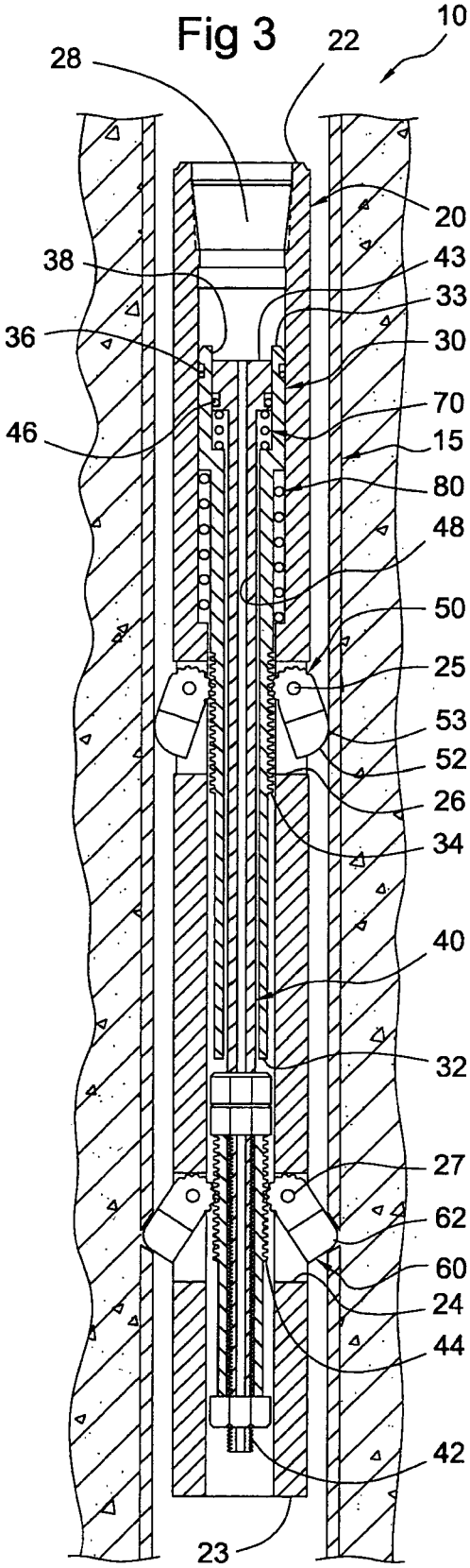
FIG. 3 represents a cross sectional view of the section mill tool assembly shown in the previous figures with the first set of blades beginning the casing sectioning work.
Figure 4:
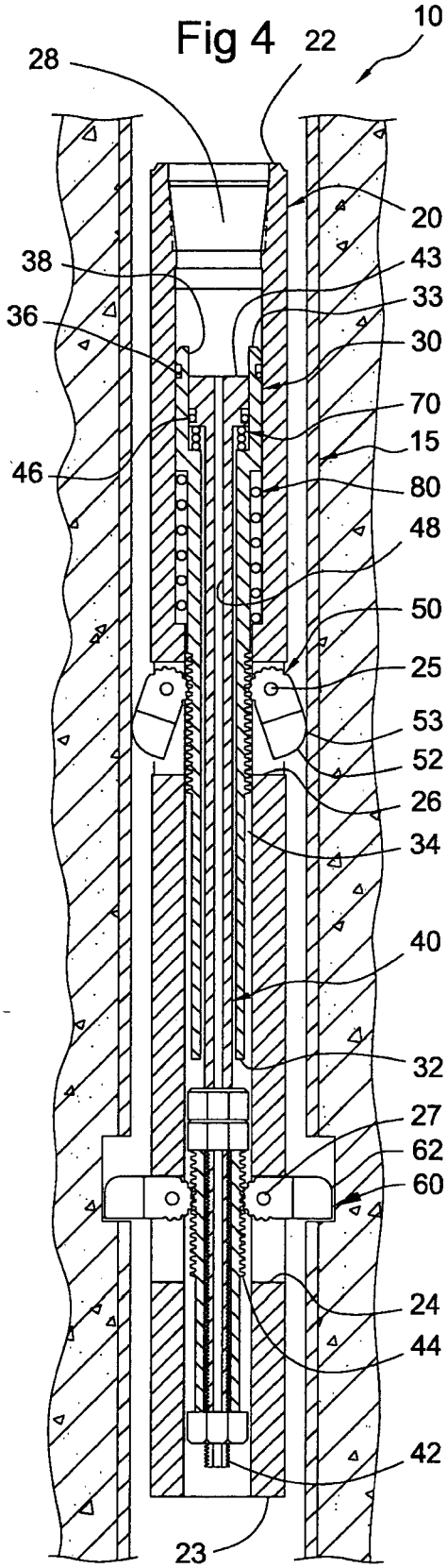
FIG. 4 shows a cross sectional view of the section mill tool assembly, with the first set of blades fully distended sectioning the casing and the second set of blades continues in slidable contact with the internal walls of the casing.
Figure 5:
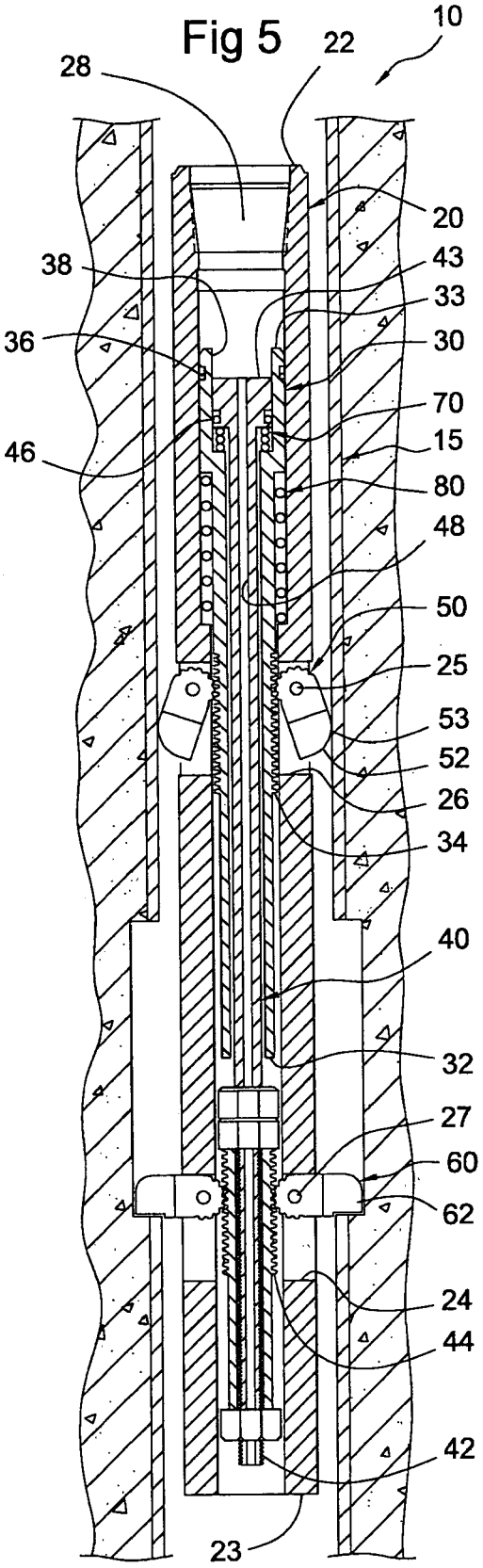
FIG. 5 shows a cross sectional view of the section mill tool assembly, with the first set of blades having sectioned a portion of the casing and being partially worn out. The second set of blades continues to be in slidable contact with the internal walls of the casing.
Figure 6:
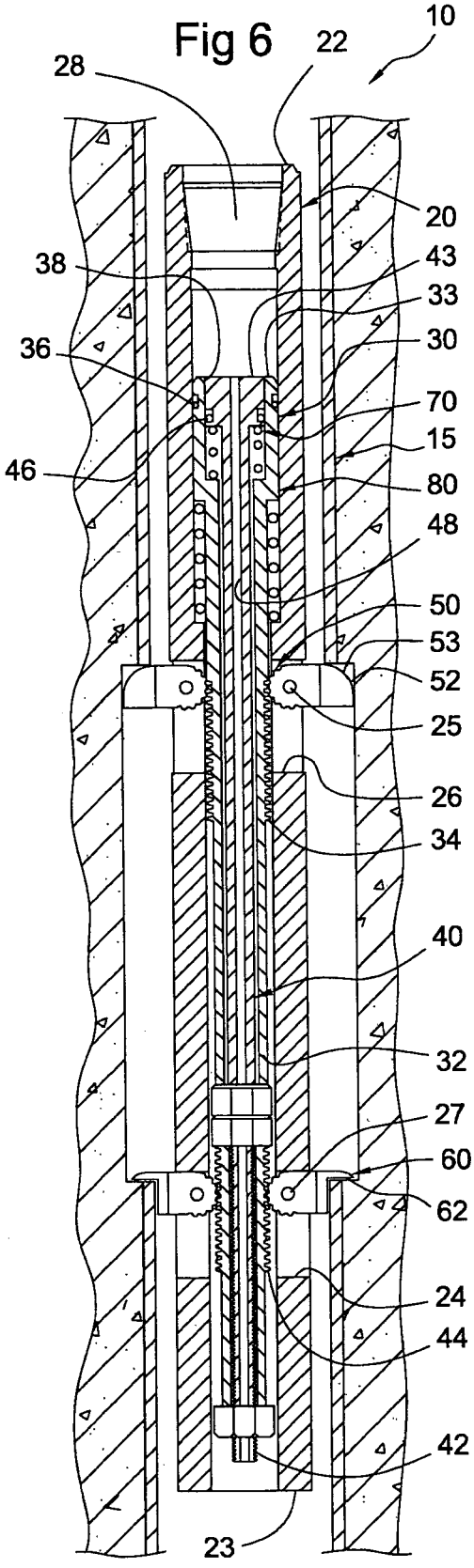
FIG. 6 illustrates a cross sectional view of the section mill tool assembly, with the first set of blades having sectioned a sufficient portion of the casing so its blades are almost completely used up and the second set of blades has reached the portion already cut by the first set of blades allowing it now to fully distend.
Figure 7:
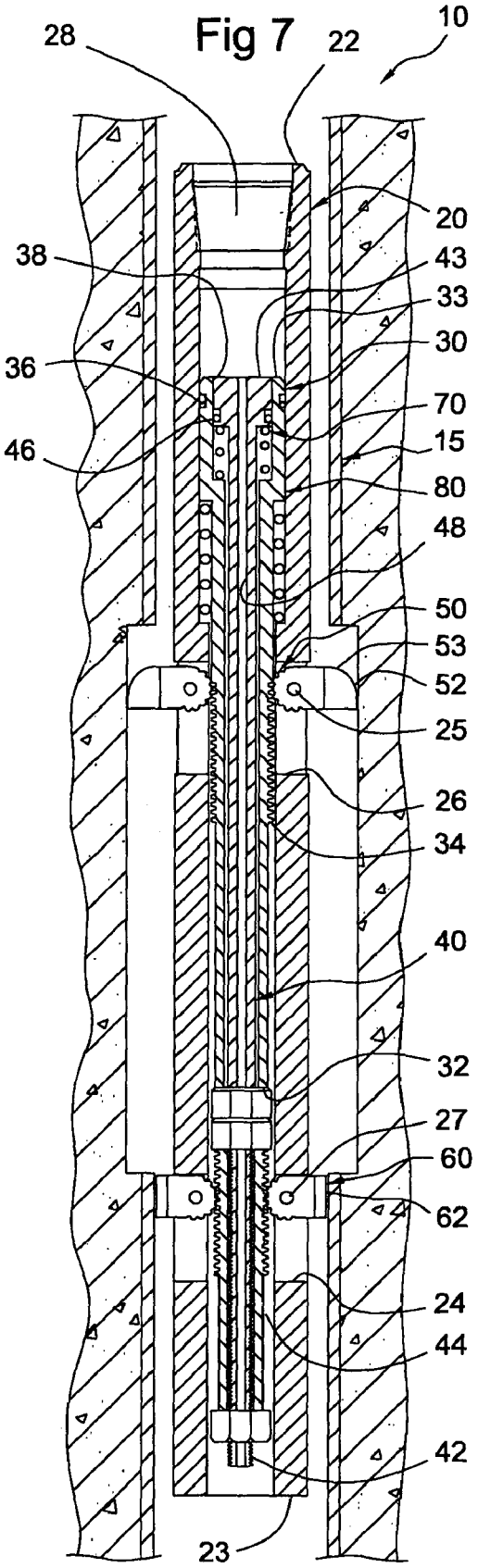
FIG. 7 shows a cross sectional view of the section mill tool assembly, with the first set of blades completely used up and the second set is advancing in the already cut portion.
Figure 8:
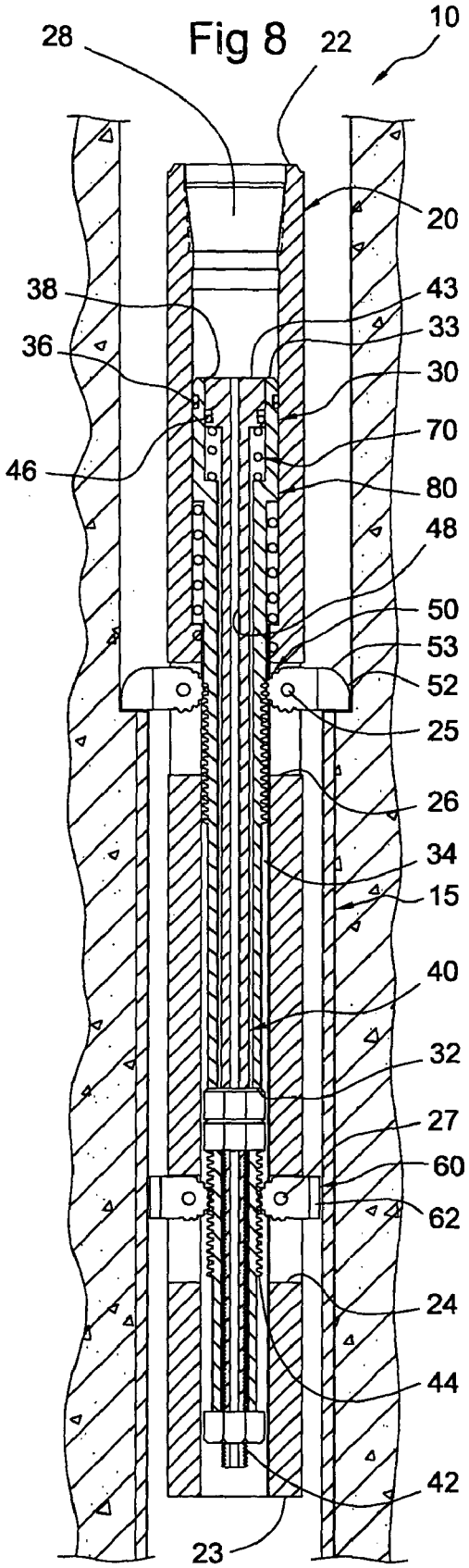
FIG. 8 shows a cross sectional view of the section mill tool assembly, with the first set of blades completely used up and the second set of blades have advanced to reach the portion of the casing where the sectioning operation needs to continue.

Referring now to the drawings, where the present invention is generally referred to with numeral 10, it can be observed that it basically includes casing 15, cylindrical assembly 20, tubular shaft assemblies 30 and 40 and first and second sets of blades 50 and 60, and their respective spring bias assemblies 70 and 80.

An oil well bore typically includes casing 15 that extends downwardly several thousand meters. Sometimes a portion collapses making it inoperational. Rather than closing the oil well and wasting the associated infrastructure investment, a portion of the casing above the problem area is sectioned and branched out to reach oil deposits through a different path. With the present invention, the second set of blades is deployed and used after the first set has been worn out completely. In sum, the cutting and reliability capabilities of the section mill is extended.

In FIG. 1, the tool subject of the present application is shown within an oil well casing, as it is being lowered to the desired location. There is no pressurized fluid applied yet. Cylindrical assembly 20 extends for several thousand meters and it includes central through opening 28 through which a source of a pressurized fluid (typically water) is forced through. Uppermost end 22 is rotably supported at the well entrance at the top. Assembly 20 includes apertures 24 and 26 at predetermined distances from the distal end 23.

Tubular shaft assembly 30 includes central through opening 38 that is coaxially aligned with central opening 28 of cylindrical assembly 20. Tubular shaft assembly 30 also includes ends 32 and 33 and teethed portions 34 at a predetermined distance from end 32. Tubular shaft assembly 30 is coaxially housed within cylindrical assembly 20. Packing member 36 seals shaft assembly 30 with respect to cylindrical assembly 20. Packing member 36 is implemented, in the preferred embodiment with an O-ring.

Figure 15:
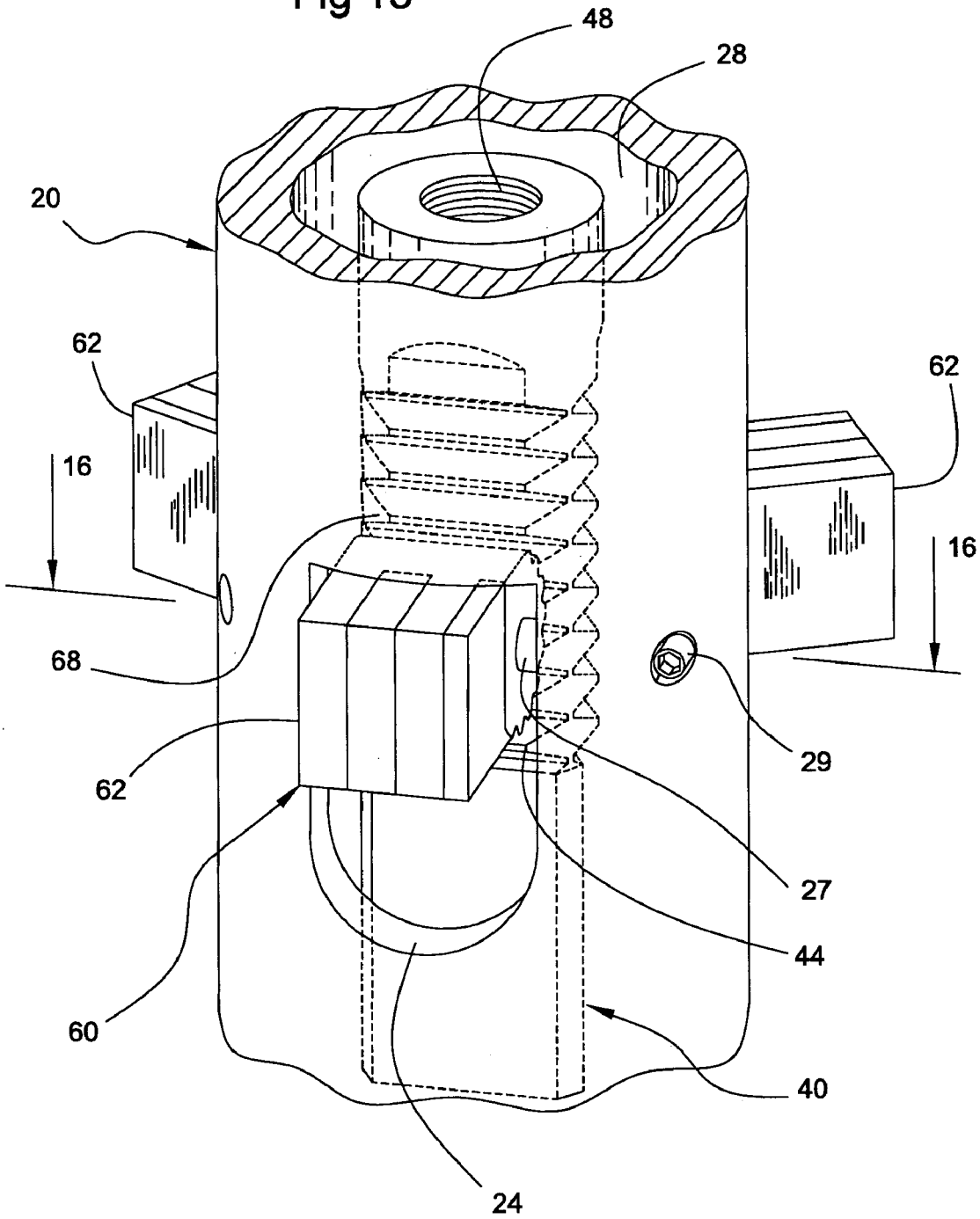
FIG. 15 shows an isometric view of the tubular shaft assembly (partially shown) with tubular shaft assembly and second set of blades mounted therein.

Tubular shaft assembly 40 includes ends 42 and 43, central through opening 48 and teethed portions 44 (as best seen in FIG. 15) at a predetermined distance from end 42. Tubular shaft assembly 40 is coaxially housed within tubular shaft assembly 30. Packing member 46 seals shaft assembly 40 with respect to shaft assembly 30. Packing member 46 is implemented, in the preferred embodiment with an O-ring.

Figure 12:
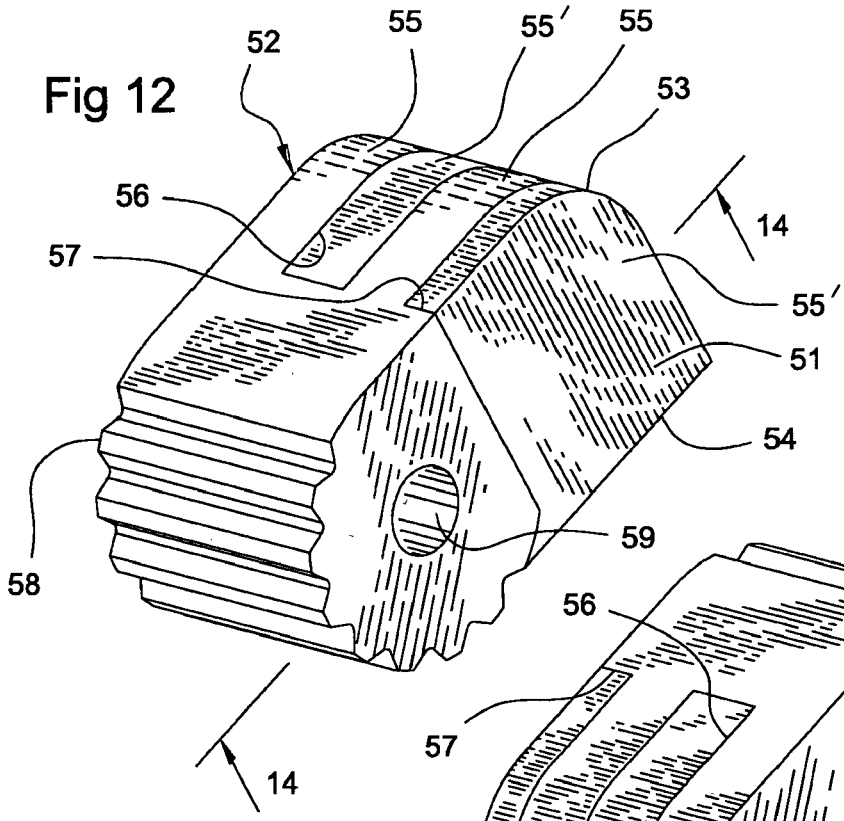
FIG. 12 shows a front isometric view of one of the blades used in the second set of blades.
Figure 13:
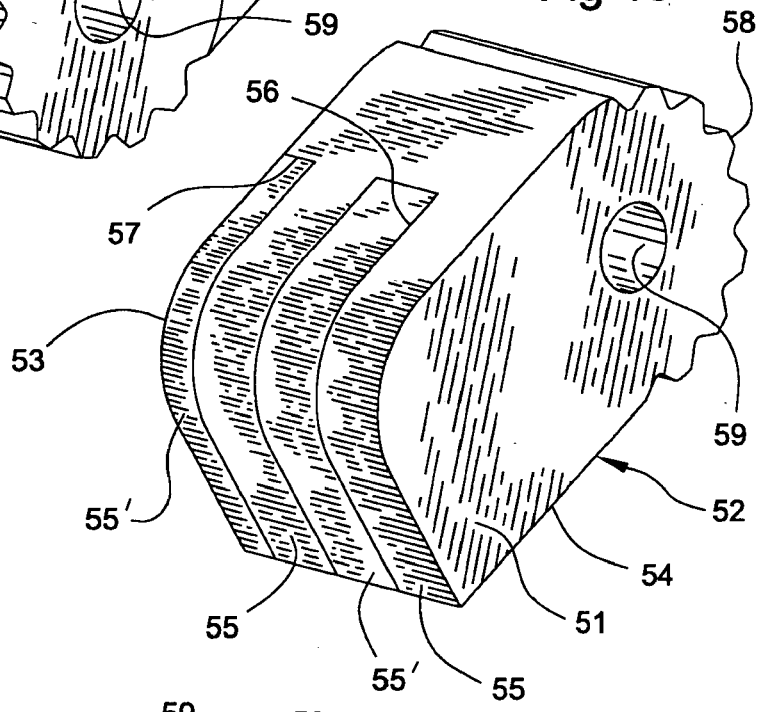
FIG. 13 shows a rear isometric view of one of the blades used in the second set of blades.
Figure 14:
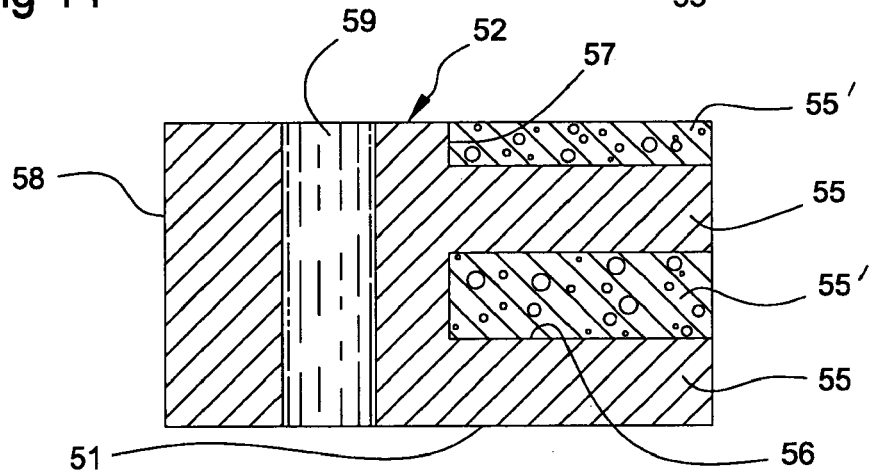
FIG. 14 is a cross sectional view of the blade shown in FIG. 12 taken from line 14—14.

First set of blades 50 (upper ones) is rotatably mounted to cylindrical assembly 20 at aperture 24. First set of blades 50 includes, in the preferred embodiment, three blade members 52 selectively movable between two extreme positions. Blade members 52 are cooperatively adapted to coact with teethed portions 34. Blade members 52 are in a substantially coaxial alignment with cylindrical assembly 20 in one of the extreme positions and are in a substantially perpendicular relationship with respect to cylindrical assembly 20 protruding radially outwardly therethrough in the other extreme position. In the latter extreme position blade members 52 are brought in operational contact with casing 15. Blade member 52 includes smooth rounded corner 53, milling edge 54, internal channel 56, cutout 57 and teethed portions 58. Smooth corner 53 comes in slidably contact with the interior surface of casing 15 when moving from the first extreme position towards the other extreme position. Teethed portion 58 has through opening 59 with cooperative dimensions to receive pin member 25 mounted to cylindrical assembly 20. In the preferred embodiment, pin member 25 is securely locked with a fastening member. Teethed portions 58 of blade members 52 cooperatively coact with teethed portions 34 of shaft assembly 30. Milling edge 54 of blade member 52 starts its cutting operation only after section mill 10 advances downwardly a sufficient distance to permit blades 52 to distend radially outwardly through casing 15 and blade members 62 have wore out. Blade member 52 is shown in more detail in FIGS. 12; 13 and 14. Member 52 also includes, in the preferred embodiment, abrasive portion 51 that in turn includes steel support plates 55 sandwiched by abrasive material layers 55'. One of the preferred and hardest abrasive materials used for the present invention is tungsten carbide.

Figure 9:
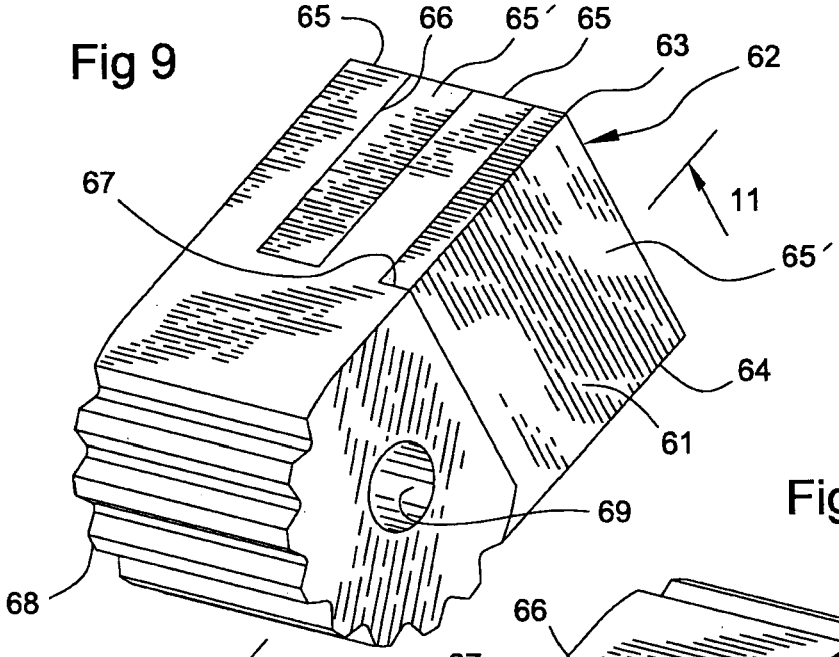
FIG. 9 shows a front isometric view of one of the blades used in the first set of blades.
Figure 10:
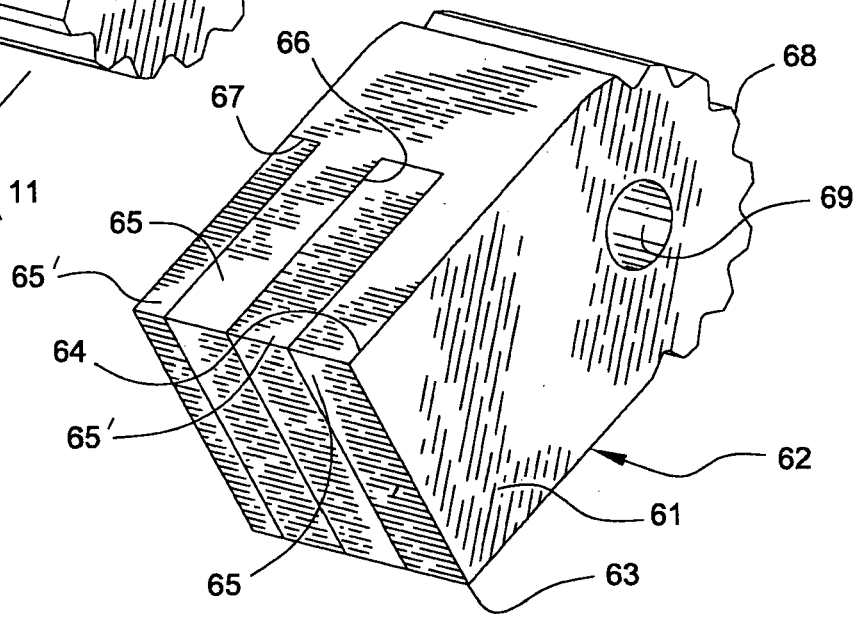
FIG. 10 shows a rear isometric view of one of the blades used in the first set of blades.
Figure 11:
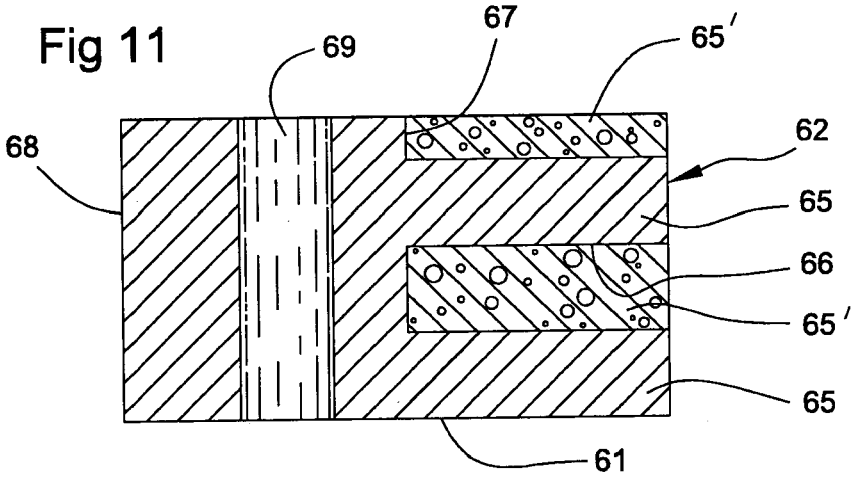
FIG. 11 is a cross sectional view of the blade shown in FIG. 9 taken from line 11—11.
Figure 16:
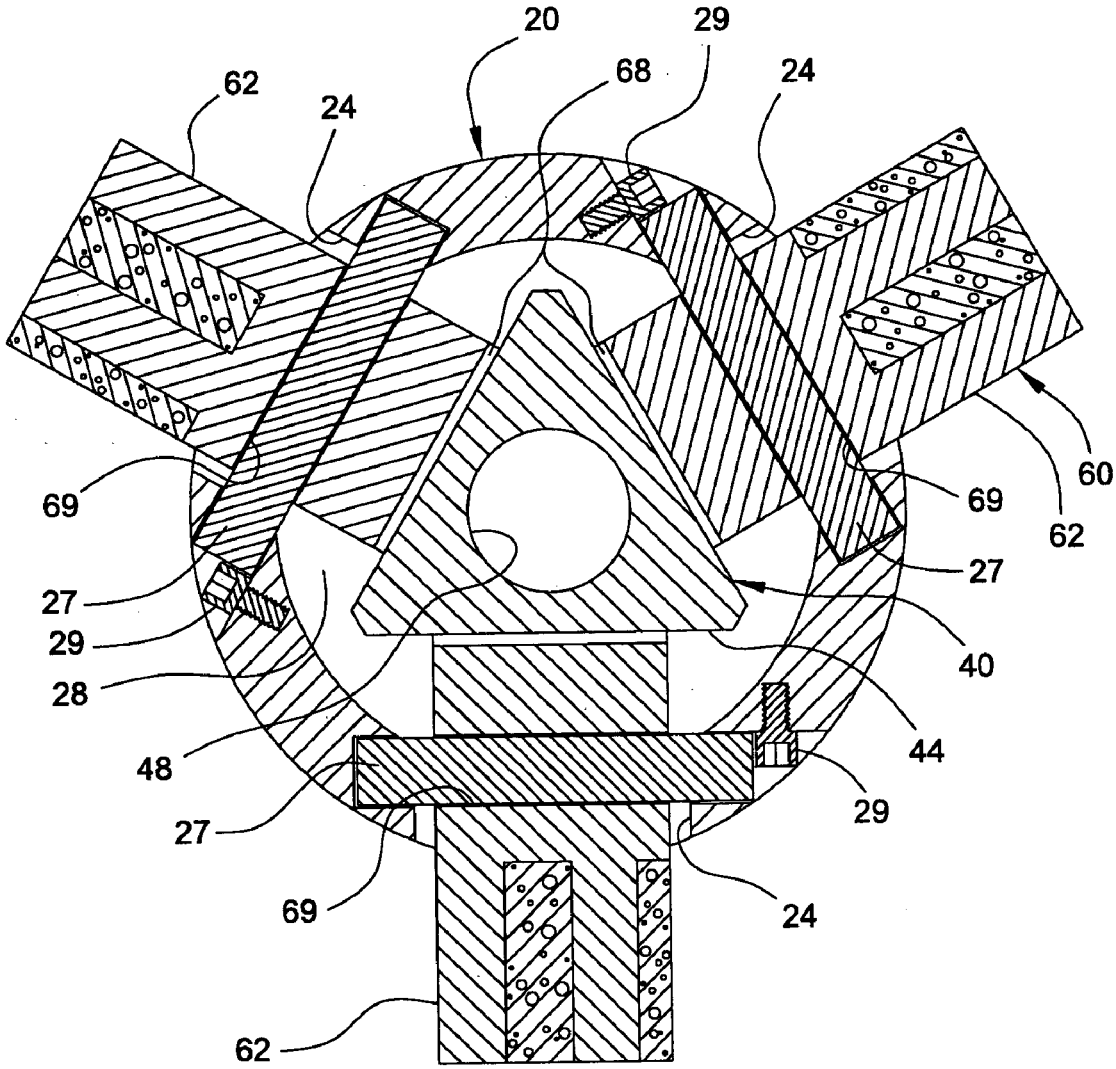
FIG. 16 is a cross section shown in FIG. 15 taken from line 16—16 showing the disposition of the blade assembly with respect to the shaft assembly and the triangular cross section of the teethed portion.

Second set of blades 60 is mounted to cylindrical assembly 20 at a predetermined distance from end 23. The distance between the location of the second set of blades 60 and end 23 is shorter than the distance between the location of first set of blades 50 and end 23. Blade members 62 are cooperatively adapted to coact with teethed portions 44. Teethed portion 68 has through opening 69 with cooperative dimensions to pivotally receive pin member 27 mounted to cylindrical assembly 20. In the preferred embodiment, fastening member 29 securely locks pin member 27, as best seen in FIGS. 15 and 16. Second set of blades 60 includes, in the preferred embodiment, three blade members 62 selectively movable between two extreme positions. Blade members 62 are in a substantially coaxial alignment with cylindrical assembly 20 in one of the extreme positions and are in a substantially perpendicular relationship with respect to cylindrical assembly 20, and protruding radially outwardly through, in the other extreme position. In this other position, blade members 62 are brought in operational contact with casing 15. Blade member 62 is shown in more detail in FIGS. 9; 10 and 11. In the preferred embodiment, abrasive portion 61 includes steel support plates 65 sandwiched by abrasive material layers 65'. Tungsten carbide is the preferred abrasive material used. Blade member 62 also includes cutting corner 63, milling edge 64, internal channel 66, cutout 67 and teethed portions 68. Cutting corner 63 is designed to start the cutting operation from the internal surface of casing 15.

Spring bias assembly 70 urges end 43 of tubular shaft assembly 40 towards end 22 and is overcome by the application of a source of pressurized fluid through central through opening 28 of cylindrical assembly 20 coacting against the surface of end 43 of tubular shaft assembly 40, so that blade members 62 are brought against casing 15 to start the cutting operation. Corner 63 of blade member 62 comes in contact with the internal surface of casing 15 and the cutting operation starts.

Spring bias assembly 80 urges end 33 towards end 22 and overcome by the application of a source of pressurized fluid through cylindrical assembly 20 coacting against end 33 of tubular shaft assembly 30, so that blade members 52 are brought against casing 15 in slidably contact therewith thereby starting the cutting operation only after the mill 10 has advanced a predetermined distance and blades 62 have been consumed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A section mill for oil wells having a casing, comprising:

A) an elongated cylindrical assembly coaxially extending within a casing and having first and second ends and including a first central through opening and said cylindrical assembly having first and second apertures at first and second predetermined distances, respectively, from said first end, said first predetermined distance being greater than said second predetermined distance;

B) means for applying a pressurized fluid to said second end;

C) a first tubular shaft assembly having third and fourth ends and including a second central through opening and said first tubular shaft assembly being coaxially housed within said cylindrical assembly and further including a first teethed portion at a third predetermined distance from said third end and said fourth end being exposed to said pressurized fluid urging said first tubular shaft assembly toward said first end;

D) a second tubular shaft assembly having fifth and sixth ends and including a third central through opening and said second tubular shaft assembly being coaxially housed within said first tubular shaft assembly and further including second teethed portion at a fourth predetermined distance from said fifth end and said sixth end being exposed to said pressurized fluid urging said second tubular shaft assembly toward said first end;

E) first blade means pivotally mounted to said cylindrical assembly within said first aperture and cooperatively adapted to coact with said first teethed portion, said first blade means including at least one first blade member selectively movable between two extreme first and second positions, said first position being in substantial coaxial alignment with said cylindrical assembly and said second position being substantially perpendicular to, and protruding radially outwardly through, said cylindrical assembly and said first blade member including a smooth corner that comes in slidable contact with said casing when urged to said second position so that said first at least one blade member is allowed to fully distend only when the section mill advances downwardly a third predetermined distance;

F) second blade means pivotally mounted to said cylindrical assembly within said second aperture and cooperatively adapted to coact with said second teethed portion, said second blade means including at least one second blade member selectively movable between two extreme first and second positions, said first-position being in substantial coaxial alignment with said cylindrical assembly and the other position being substantially perpendicular to, and protruding radially outwardly through, said cylindrical assembly so that said at least one second blade member is brought in operational cutting contact with said casing;

G) first spring bias means to urge said fourth end towards said second end and overcome by the application of a source of pressurized fluid through said cylindrical assembly coacting against said fourth end of said first tubular shaft assembly so that at least one of said first blade members is urged against said casing and said first blade members being allowed to distend towards said second position only when said section mill advances a predetermined distance and there is no casing;

H) second spring bias means to urge said sixth end towards said second end and overcome by the application of a source of pressurized fluid through said cylindrical assembly coacting against said sixth end of said second tubular shaft assembly so that at least one of said second blade members is brought against said casing in cutting contact therewith thereby starting the cutting operation;

I) first packing means for sealing said cylindrical assembly with respect to said first shaft means;

J) second packing means for sealing said first shaft means with respect to said second shaft means.

2. The section mill for oil wells set forth in claim 1 wherein said first and second teethed portions have a triangular cross-section.

3. The section mill for oil wells set forth in claim 2 wherein said first and second blade members include at least one supporting plate sandwiched by a layer of abrasive material.

4. The section mill for oil wells set forth in claim 3 wherein said abrasive material is tungsten carbide.

* * * * *